US005136913A

United States Patent [19]

Konishi

[11] Patent Number: 5,136,913

[45] Date of Patent: Aug. 11, 1992

[54] PLAY CONTROL DEVICE FOR ELECTRONIC MUSICAL INSTRUMENT

[75] Inventor: Shinya Konishi, Shizuoka, Japan

[73] Assignee: K.K. Kawai Gakki Seisakusho, Shizuoka, Japan

[21] Appl. No.: 616,527

[22] Filed: Nov. 21, 1990

[30] Foreign Application Priority Data

Nov. 24, 1989 [JP] Japan ..... 1-306100

[51] Int. Cl.[5] ..... G10H 1/18

[52] U.S. Cl. ..... 84/617; 84/635; 84/655; 84/667; 84/DIG. 12

[58] Field of Search ..... 84/635, 667, DIG. 12, 84/617, 618, 655, 656

[56] References Cited

U.S. PATENT DOCUMENTS 5,001,959 3/1991 Kimpara ..... 84/635

*Primary Examiner*—William M. Shoop, Jr.
*Assistant Examiner*—Brian Sircus
*Attorney, Agent, or Firm*—Sughrue, Mion, Zinn, Macpeak & Seas

[57] ABSTRACT

A rhythm play control device for an electronic musical instrument stores the number of operations of a single operator, and includes a memory device and a central processing unit which responds thereto to perform a change of play mode of the instrument.

7 Claims, 4 Drawing Sheets

PANEL SCAN MAP

PLAY CONTROL DEVICE FOR ELECTRONIC MUSICAL INSTRUMENT

BACKGROUND OF THE INVENTION

The present invention relates to a play control device for an electronic musical instrument having a single operator for operating rhythm play therefor.

FIG. 5 shows an example of an operation panel of an electronic musical instrument capable of playing rhythm. In FIG. 5, a reference numeral 1 depicts an operation panel, 2 a plurality of rhythm selection switches, 3 a plurality of tone selection switches, 4 a pair of tempo switches, successive depressions of one, for example, right one, of which causes tempo to be increased gradually, 5 an intro/ending switch, 6 a start/stop switch and 7 a fill-in rhythm insertion switch. When an operator of the operation panel 1 is adequately operated under a control of a central processing unit which is not shown, a rhythm play can be started. When a desired one of the rhythm selection switches 2, a desired one of the tone selection switches 3 and a desired one of the tempo switches 4 are selected and when the intro/ending switch 5 is operated, a play of rhythm is started from its rhythm introduction part. If it is desired to play rhythm without an introduction part thereof, the start/stop switch 6 is first operated. When a fill-in rhythm insertion into a main part of rhythm on play is desired, the switch 7 is operated. When it is desired to stop the rhythm, the start/stop switch 6 is operated and when it is desired to stop after an ending part of rhythm, the intro/ending switch 5 is operated.

These processings are controlled by the central processing unit which monitors statuses of the respective switches on the operation panel 1 and operates as shown in a flowchart shown in FIG. 6.

As will be clear for players of electronic musical instruments, a plurality of switches such as switch 6 for controlling play of a main rhythm part and switch 5 for controlling play of rhythm from an introduction part thereof sometimes lead to an erroneous operation. In addition thereto, such a large number of switches requires a considerable area on a panel.

SUMMARY OF THE INVENTION

An object of the present invention is to provide a rhythm play control device for an electronic musical instrument which has an easily operable, single operator for start and stop of play.

According to the present invention, the above object can be achieved by a play control device in which the number of operations of a single operator is stored in a storage device and a central processing unit performs a change of play mode according to the number of operations of the operator or when a desired rhythm play ends.

DETAILED DESCRIPTION OF THE PREFERRED EMBODIMENTS

Figure 1:
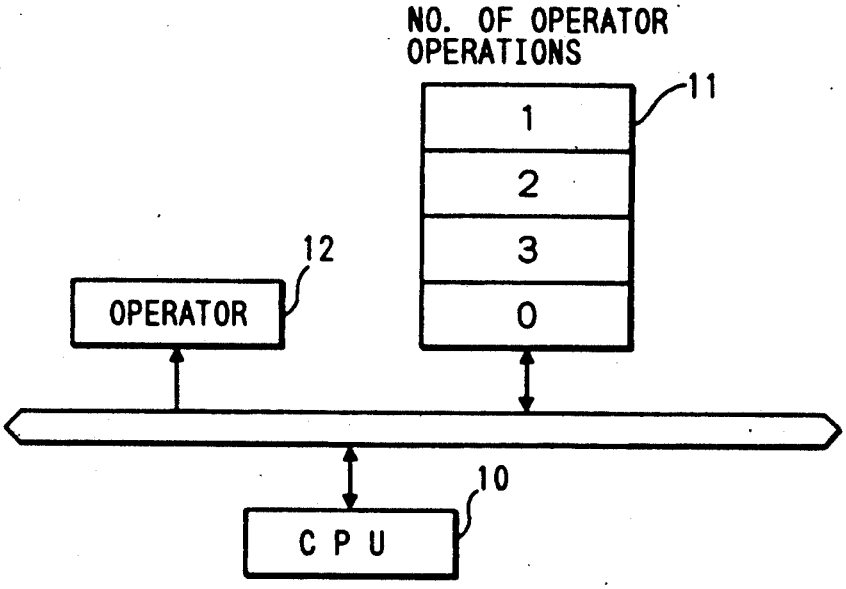
FIG. 1 shows a basic construction of the present invention.

In FIG. 1 which shows a basic construction of the present rhythm play control device of an electronic musical instrument for making the instrument possible to play continuously a rhythm introduction part, a main rhythm part and a rhythm ending part, a reference numeral 10 depicts a central processing unit, 11 a memory device having regions for storing the number of operations of a single operator and rhythm play statuses corresponding thereto and 12 the single operator.

The operator 12 has a single construction and the memory device 11 which is read/write controlled by the central processing unit 10 has a region for storing the number of operations of the operator 12 corresponding to a rhythm playing status. The central processing unit 10 processes data to shift the playing status to a second playing status corresponding to a second number of operations when the number of operations of the operator 12 increases to the second number or when a certain rhythm play status ends.

When it is detected by scanning the operation panel that a first operation of the operator 12 is performed, it is counted and written in a certain location of the memory region of the memory device 11. The count "1" thus stored corresponds to a play of a rhythm introduction part and is read out by the central processing unit 10. The central processing unit 10 performs a predetermined processing to play the rhythm introduction part. When a player of this musical instrument decides that such an introduction part is unnecessary and he operated the operator 12 twice, count "2" is written in another location of the memory region 11. Alternatively, when the play of introduction part completes, the playing status is shifted to one corresponding to count "2" to play a main rhythm part. When the operator 12 is operated three times, it corresponds to a play of rhythm ending part and the play is ended by an end of play of the ending part. Alternatively, when a fourth operation of the operator 12 is performed immediately after the third operation thereof, the play of ending part is omitted.

The present invention which performs the operations mentioned above can be constituted in hardware similarly to that of the conventional device. That is, the present device includes a memory device for storing a program for controlling an operation of the central processing unit and data for automatic playing and a memory device having storage regions for storing the value indicative of status of play shown in FIG. 1, that is, the number of operations of the operator 12, and panel operation works and registers necessary to detect various events.

Figure 2:
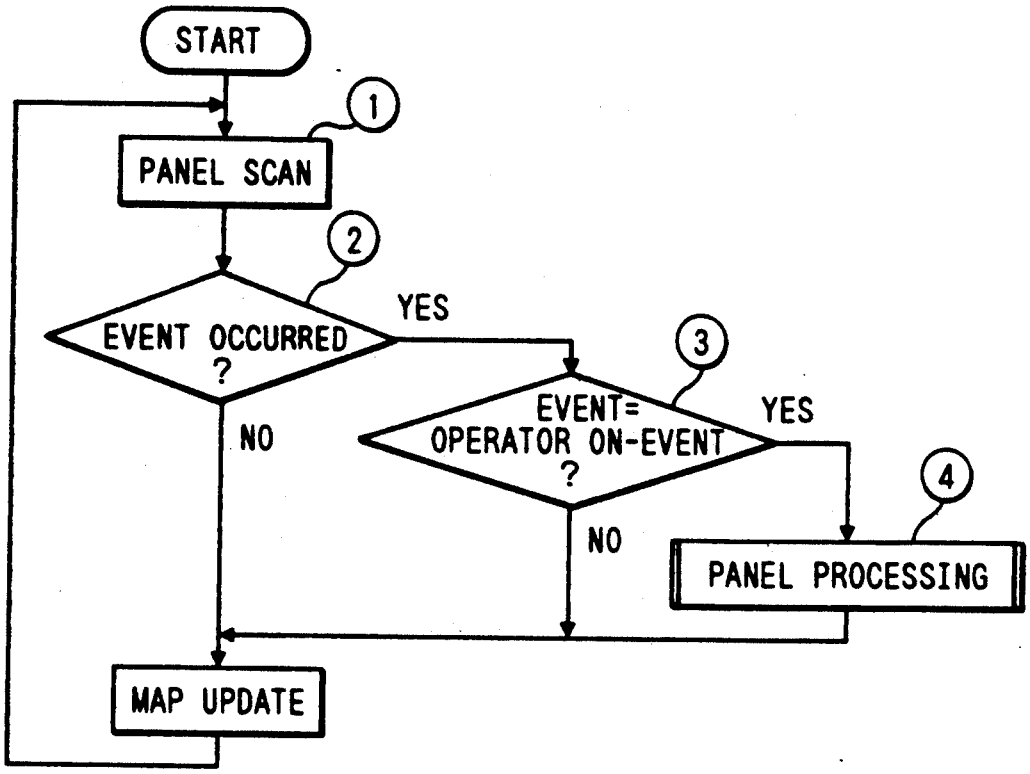
FIG. 2 is a flowchart showing an operation program of a central processing unit in FIG. 1.

FIG. 2 is a flowchart of an operation of the central processing unit 10. In FIG. 2, the panel surface is scanned in the step 1 and a result is stored in a new data storage portion of a panel surface operation map shown in FIG. 3. In the step 2, the new data is compared with an old data stored in an old data storage portion of the map in FIG. 3 to detect if any event occurred. When there is an event, it is decided in the step 3 whether or not the event is an on-event of the operator 12. If yes, a panel processing is performed in the step 4.

Figure 3:
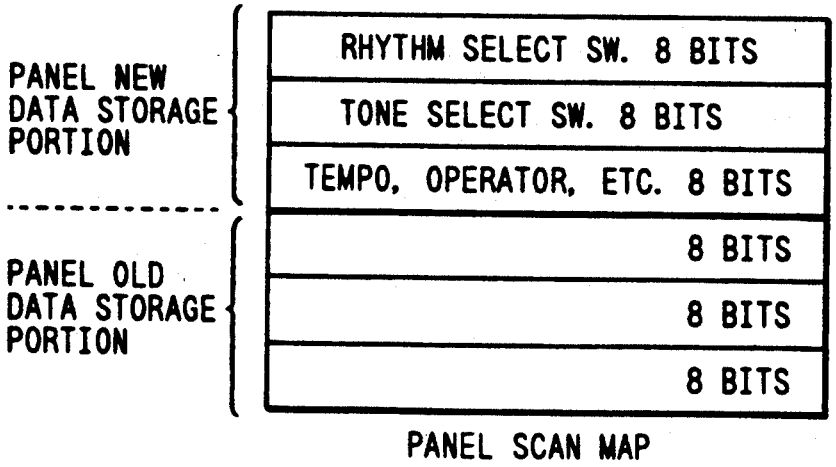
FIG. 3 shows a content of a panel surface scan map to be produced in the operation shown by the flowchart in FIG. 2.

When it is decided in the step 2 that there is no event, when it is decided in the step 3 that the event is not an on-event of.the operator 12 or when the panel processing in the step 4 is completed, the old data in the map shown in FIG. 3 is erased and instead thereof the new data is shifted to the old data storage portion. Then, the new data storage portion of the map is ready to store the next new data. It should be noted that the panel scan map is provided in a portion other than the region of the memory device in which the number of operations of the operator 12 is stored.

Figure 4:
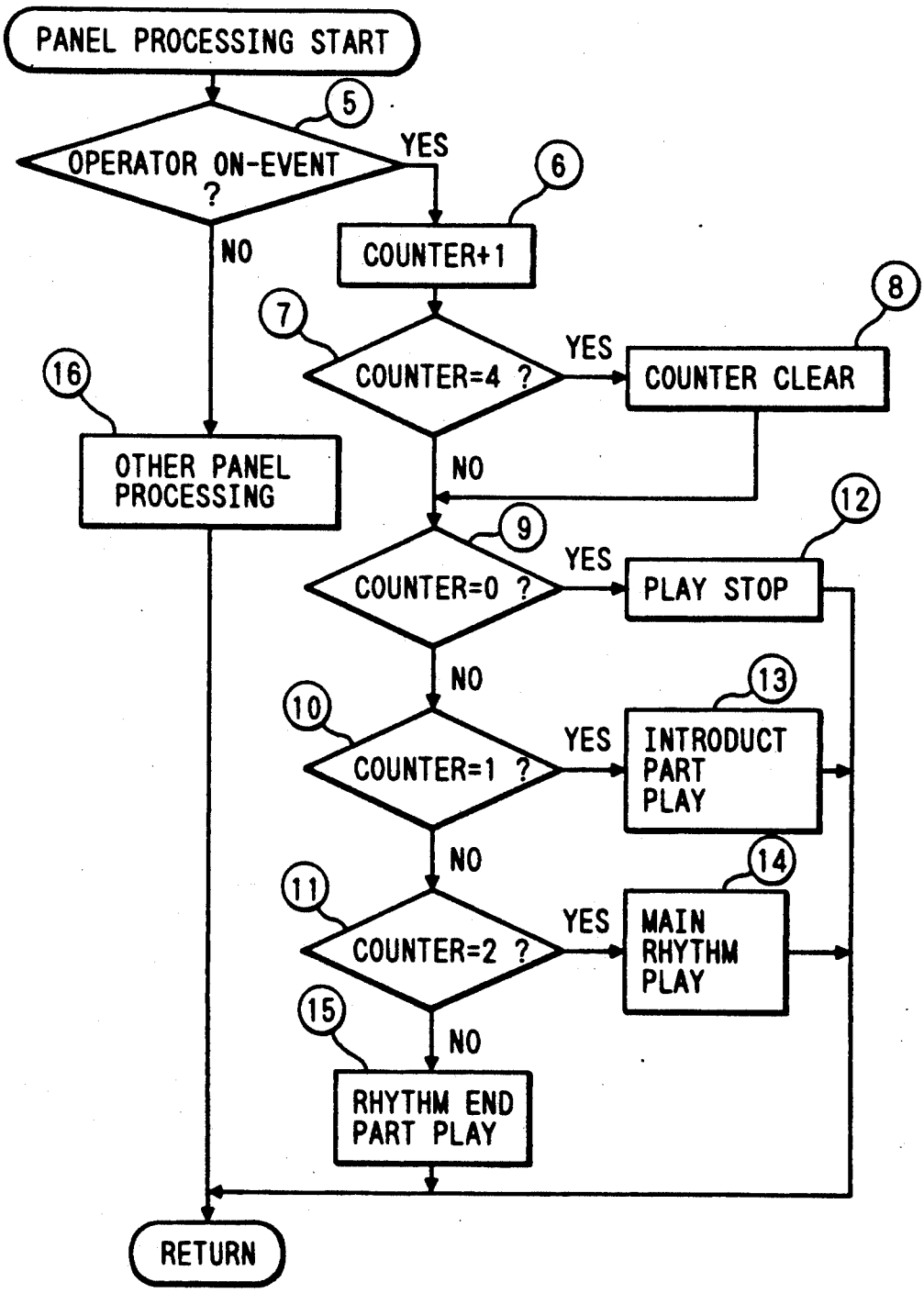
FIG. 4 is a detailed flowchart of a panel processing in FIG. 2.
Figure 5:
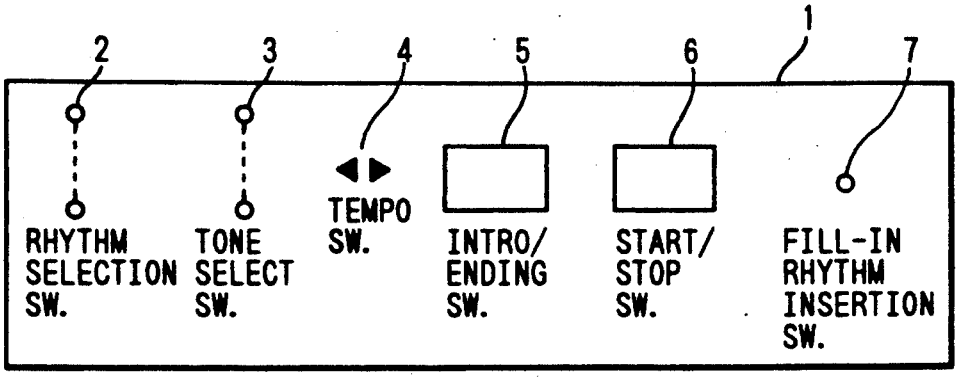
FIG. 5 PRIOR ART
FIG. 5 shows an operation panel of a conventional electronic musical instrument.
Figure 6:
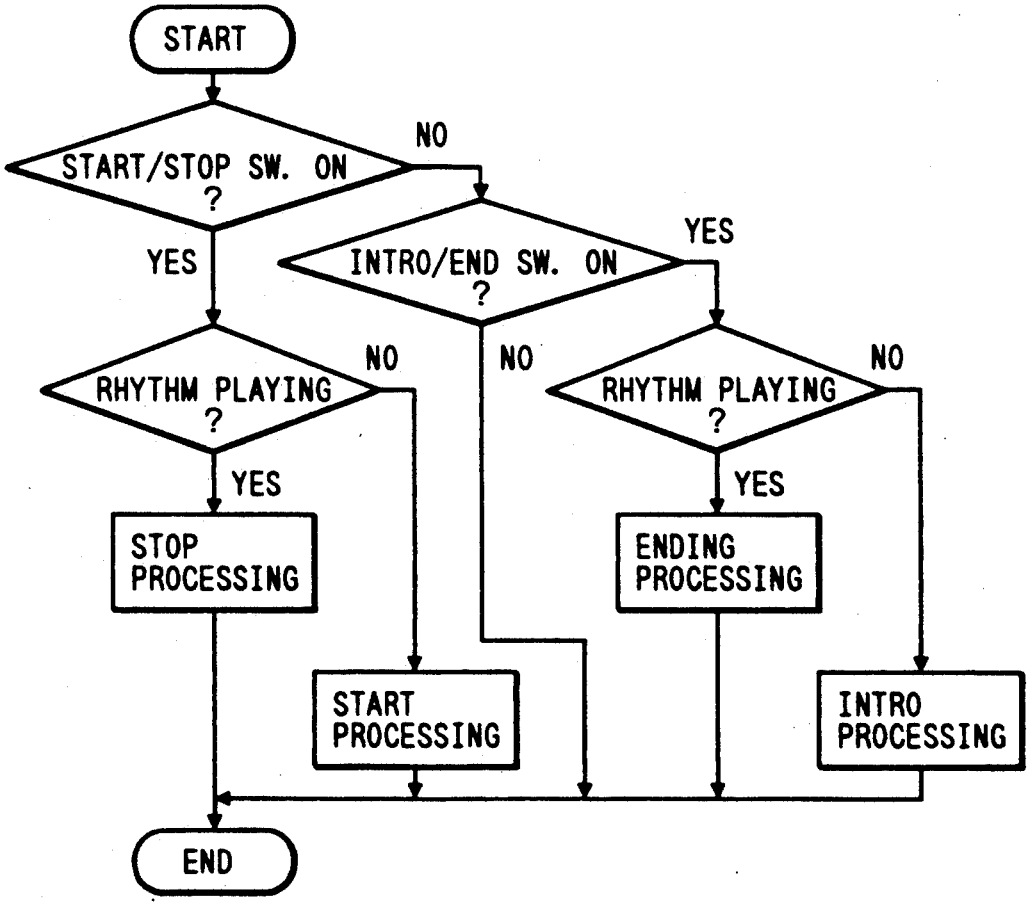
FIG. 6 is a flowchart of operation of the musical instrument shown in FIG. 5.

FIG. 4 is a detailed flowchart of the panel processing to be done in the step 4 of the flowchart shown in FIG. 2. In FIG. 4, it is decided in the step 5 whether or not the on-event of the operator 12 is related to a play control. If yes, the counter (not shown) for counting the number of operations of the operator 12 is incremented in the step 6. Then, in the step 7, it is checked whether or not the counter value is 4. If yes, the counter is cleared in the step 8. If it is not 4 or when the counter is cleared, it is checked in the step 9 whether or not the counter content is zero. If yes, the playing is stopped in the step 12. If no, then, it is checked in the step 10 whether or not the counter content is 1. If yes, an introduction part of rhythm is played in the step 13. If no, then, it is checked in the step 11 whether or not the counter content is 2. If yes, the main part of rhythm is played in the step 14 and, if no, the ending part of rhythm is played in the step 15. The flowchart returns to the main routine when a play of desired part of rhythm ends, it becomes a play stop state or a panel processing other than the operator on-event is performed in the step 16.

As mentioned, the memory device stores the number of operations of the operator 12 and the counter is incremented when the processing correponding to the stored number of operator operations is completed, even if the operator 12 is not operated. Alternatively, the operation can be shifted to a subsequent processing when the counter content is changed by an operation of the operator 12 even when the processing proceeds.

In an electronic musical instrument for performing an automatic play of rhythm, there is a case where a main rhythm part of a predetermined length is played repeatingly. In such case, the main part is repeated after an introduction part is played. When the operator 12 is operated a certain number of times corresponding to a play of ending part of rhythm or a stop of play, respective processings are performed correspondingly.

According to the present invention, a single operator is used to control a start or stop of play on an operation panel. Therefore, the possibility of player's erroneous operation of the operator is minimized and the area on the operation panel can be minimized compared with the conventional device.

What is claimed is:

1. A control device for controlling play of an electronic musical instrument having an operation panel, said musical instrument being capable of selectively playing a plurality of different rhythm parts, said control device comprising:

a single operator provided on said operation panel of said musical instrument, a memory device having regions for storing numbers of operations of said single operator and rhythm play statuses corresponding thereto, and a central processing unit responsive to the number of operations of said single operator stored in said regions for controlling a status of play of rhythm to shift said status from a first status corresponding to a first number of operations of said single operator to a second status corresponding to a second number of operations when the number of operations of said single operator is increased or a specified rhythm part has been completed.

2. A control device according to claim 1, wherein said memory device stores a program for controlling an operation of said central processing unit and data for automatic playing, said memory device having storage regions for storing the values indicative of the status of play.

3. A control device according to claim 1, wherein said central processing unit scans said panel surface, a result of said scanning by said central processing unit being stored in a data storage portion of a panel surface operation map of said memory device.

4. A control device according to claim 3, wherein said panel scan map is provided in a portion other than said regions of said memory device in which the number of operations of said operator is stored.

5. A control device according to claim 1, further comprising a counter which is incremented when processing by said central processing unit corresponding to the stored number of operator operations is completed.

6. A control device according to claim 1, further comprising a counter, whereby the status of operation can be shifted to a subsequent status of operation when a content of said counter is changed by an operation of said operator during processing.

7. A control device according to claim 1, wherein said plurality of rhythm parts include an introduction part of rhythm, a main rhythm part and an ending part of rhythm.

* * * * *